US006564733B2

(12) United States Patent
Butzen et al.

(10) Patent No.: US 6,564,733 B2
(45) Date of Patent: May 20, 2003

(54) DEVICE FOR MONITORING THE BOBBIN THREAD ON DOUBLE THREAD LOCKSTITCH SEWING MACHINES

(75) Inventors: Edgar Butzen, Landstuhl (DE); Manfred Neurohr, Kaiserslautern (DE); Karl Manuel, Otterbach (DE)

(73) Assignee: PFAFF Industrie Maschinen AG (DE)

( * ) Notice: Subject to any disclaimer, the term of this patent is extended or adjusted under 35 U.S.C. 154(b) by 0 days.

(21) Appl. No.: 10/217,355

(22) Filed: Aug. 12, 2002

(65) Prior Publication Data

US 2003/0029365 A1 Feb. 13, 2003

(30) Foreign Application Priority Data

Aug. 13, 2001 (DE) ..... 101 40 636

(51) Int. Cl.[7] ..... D05B 69/36
(52) U.S. Cl. ..... 112/273
(58) Field of Search ..... 112/278, 273; 242/118.4; 200/61.15, 61.16, 61.18

(56) References Cited

U.S. PATENT DOCUMENTS 5,078,331 A * 1/1992 Mardix et al. ..... 112/273 X
5,651,324 A * 7/1997 Arnold ..... 112/278

* cited by examiner

*Primary Examiner*—Peter Nerbun
(74) *Attorney, Agent, or Firm*—McGlew and Tuttle, P.C.

(57) ABSTRACT

A monitor is provided for a bobbin thread on double thread lockstitch sewing machines. This is preferably a sewing machine with a rotating hook with a bobbin housing accommodating the lower thread reserve. The monitor includes a revolution sensor which sends a pulse per revolution of the main shaft of the machine to a microcomputer. An infrared laser light transmitter sends a detection beam directed toward a bobbin. The beam is reflected by the bobbin or by the roll of a residual thread length to a receiver and is sent by the latter to the microcomputer in the form of signals for processing, evaluation and/or forwarding. The microcomputer is adapted to compare the different signal patterns with a detection threshold (DS) to generate signals for controlling the sewing machine. A controllable power source is connected to the microcomputer for the occasional, stepwise reduction of the output of the infrared laser light transmitter. A bobbin can be inserted into the bobbin housing with at least two chambers separated from one another by a radially directed web. One chamber (the residual thread chamber) accommodates a residual thread length and the other chamber (the main chamber) accommodates the main thread length. The front surface of the web faces the infrared laser light transmitter as well as the outer surface of the flange of the bobbin. This outer surface is adjacent to the front surface, reflecting light, wherein the flange has openings for the detection beam.

12 Claims, 6 Drawing Sheets

DEVICE FOR MONITORING THE BOBBIN THREAD ON DOUBLE THREAD LOCKSTITCH SEWING MACHINES

FIELD OF THE INVENTION

The present invention pertains to a means for monitoring the lower thread on double thread lockstitch sewing machines with a preferably rotating hook.

BACKGROUND OF THE INVENTION

A means for recognizing the approaching end of the lower thread of a sewing machine with a double thread lockstitch hook, which makes it possible to still have a defined residual thread length available after the recognition of the approaching thread end regardless of the particular thread strength being used, is shown in DE 40 31 058 C1.

A web, which is directed essentially in parallel to the flanges of the bobbin and whose lateral surfaces are reflective, is provided for this purpose on the hub of the bobbin. Openings are provided in the flanges of the bobbin, whose surfaces have a light-absorbing layer or have a dull finish, for the infrared rays emitted from a reflection head, which fall laterally on the thread roll, passing through the flange of the bobbin or through the openings in the flange when the bobbin is still filled sufficiently, and are absorbed. As long as the infrared rays are not reflected by the reflection head, no signal can be sent by the reflection head.

If the thread roll has been used up to the extent that the external diameter of the residual thread length is smaller than the external diameter of the web, the infrared rays passing through the openings in the flange fall on the lateral surface of the web and are sent back to the reflection head. A signal, which is used for the further control of the sewing machine and which can be used either to stop the machine immediately or to still form a defined number of residual stitches, is generated as a result.

Since it makes no difference for the absorption of the infrared ray whether it falls on the stationary surface of the flange of the bobbin or on the stationary thread roll or whether the latter are rotating, the approaching end of the bobbin thread can be recognized or displayed with this means in the case of a machine operating properly, but it is not possible to recognize a disturbance in sewing, e.g., a thread break, because if a break of the needle thread or of the lower thread occurs during sewing while the bobbin is still filled with a relatively large amount of thread, the infrared ray is not sent back by the flange of the bobbin or the thread roll to the reflection head, and no output signal is consequently generated.

An improvement of the above-described means, which pertains essentially to the increase in the reliability of operation of the said means, is shown in DE 41 15 520 A1, in which infrared rays emitted by a reflection head are likewise returned by a reflection surface arranged at the bottom of the hook body to the reflection head. Openings for the infrared ray are provided for this purpose both in the upper part of the bobbin housing, on the one hand, and in the two flanges of the bobbin, on the other hand. Moreover, the bobbin is equipped in an advantageous embodiment with two webs arranged at spaced locations from one another, in which openings, which are arranged on the same pitch circle as the openings in the flanges of the bobbin, are likewise provided for the infrared ray. The arrangement of all openings is selected now to be such that in the case of a bobbin having only a residual thread length, the infrared ray emitted by the reflection head reaches the reflection surface through the openings of the upper part of the bobbin housing, of the first bobbin flange, the two webs, the lower part of the bobbin housing as well as the hook body and is returned therefrom to the reflection head. The signal originating from this as a result can then be used either to stop the machine immediately or to still work off at least part of the residual thread length.

If the bobbin is still filled with thread to such an extent that the openings in the webs of the bobbin are covered by the residual thread roll, the infrared ray is absorbed. It makes absolutely no difference whether this happens with the bobbing rotating or stopped. If breaking of the needle thread or lower thread occurs during sewing with the bobbin still filled with a relatively large amount of thread, the infrared ray is not returned by the flange of the bobbin or the thread roll to the reflection head in this means, either, and no output signal is consequently generated, either.

Even though contamination of the reflection surface by settling dust generated during the sewing is counteracted in this means by the needle thread moving over the reflection surface during the stitch formation, this means is nevertheless relatively susceptible to fault because of the plurality of openings through which the infrared light ray passes and is correspondingly expensive to manufacture, especially because it additionally also requires an adapted bobbin housing lower part and a hook body provided with a reflection foil besides an adapted bobbin housing top part and a corresponding bobbin.

DE 34 47 138 A1 shows a means for double thread lockstitch sewing machines, which generates signal sequences that can be assigned to the particular instantaneous operating state depending on that operating state, wherein a signal sequence with a sequence changing in a pronounced sinus-like pattern is generated in the case of a sufficiently filled bobbin and trouble-free sewing operation, a signal sequence with intermittent residual ripples is generated in the case of a bobbin that is no longer filled sufficiently, and, finally, a signal sequence of a constant pattern is generated in the case of stoppage of the bobbin, which corresponds to a disturbance. When the bobbin is still filled sufficiently and rotating, the infrared light ray emitted by a reflection head is reflected alternatingly by the thread reserve covering the openings and by the reflecting surfaces of the particular bobbin flange, which surfaces are located between these openings, as a result of which the above-mentioned signal sequence changing in a pronounced sinus-like pattern is generated. By contrast, the openings are free in the case of a bobbin having only the residual thread length, and the signal sequence is formed alternatingly by the likewise reflecting inner side of a first bobbin flange and the reflecting outer side of the second bobbin flange. Even though this signal sequence is called a "a signal sequence with horizontal residual ripples" in A1, with respect to FIG. 3 in that document, it can be assumed in light of the essentially equal degree of reflection of the inner and outer sides of the bobbin flanges that a signal sequence thus formed is basically a continuous signal. Since the infrared light ray reaches the inner side of a bobbin flange either through one of the openings and is reflected by same or falls on the area of the outer side of the bobbin flange located between the openings and is reflected by same during the stoppage of the bobbin, it is obvious that there can be no substantial difference between the signal sequence generated in the case of a bobbin that is filled only with a residual thread length and is rotating and the bobbin that is likewise filled only with a residual thread length but is stopped. It is therefore extremely difficult to distinguish a rotating bobbin from a stopped bobbin based on the signal sequences thus generated in the case of bobbins filled with a residual thread length only.

SUMMARY OF THE INVENTION

The basic object of the present invention is therefore to provide a means for monitoring the three possible operating states of a double thread lockstitch sewing machine, namely, when the degree of filling of the bobbin is still above a residual thread length, or the machine is processing thread of the residual thread length, or when there is a disturbance causing the stoppage of the bobbin, e.g., a thread break, which means can be manufactured at a low cost and is very extensively insensitive to contamination by dust generated during sewing.

According to the invention, a monitor is provided for a bobbin thread on double thread lockstitch sewing machines. This is preferably a sewing machine with a rotating hook with a bobbin housing accommodating the lower thread reserve. The monitor includes a revolution sensor which sends a pulse per revolution of the main shaft of the machine to a microcomputer. An infrared laser light transmitter sends a detection beam directed toward a bobbin. The beam is reflected by the bobbin or by the roll of a residual thread length to a receiver and is sent by the latter to the microcomputer in the form of signals for processing, evaluation and/or forwarding. The microcomputer is adapted to compare the different signal patterns with a detection threshold (DS) to generate signals for controlling the sewing machine. A controllable power source is connected to the microcomputer for the occasional, stepwise reduction of the output of the infrared laser light transmitter. A bobbin can be inserted into the bobbin housing with at least two chambers separated from one another by a radially directed web. One chamber (the residual thread chamber) accommodates a residual thread length and the other chamber (the main chamber) accommodates the main thread length. The front surface of the web faces the infrared laser light transmitter as well as the outer surface of the flange of the bobbin. This outer surface is adjacent to the front surface, reflecting light, wherein the flange has openings for the detection beam.

The use of an infrared laser light transmitter offers the advantage of coherent radiation, such as a high degree of parallelism and consequently intense bundling of the radiation, high emission output and high monochromatism compared with the infrared light transmitters used hitherto.

Especially because of the high parallelism and the high emission output, the advantage is achieved here that both the infrared laser light transmitter and a receiving phototransistor acting as a receiver can be arranged at a relatively great distance from the bobbin and deflecting mirrors or prisms can thus be eliminated, on the one hand, and the susceptibility to dust is substantially reduced, on the other hand.

Furthermore, bobbins with a degree of reflection usual for metals can be used in the means according to the present invention, so that it is also possible to use, e.g., commercially available bobbins with a chamber for the residual thread length and with a chamber for the main thread length, and the distance between the outer side of the flange of the bobbin and the front surface of the web limiting the chamber for the residual thread length, which said front surface is located adjacent to the outer side, is sufficient for obtaining signals of sufficient intensity from the flange of the bobbin and the front surface of the web.

If the microcomputer has a stitch countdown counter, into which the number of stitches or seams or workpieces that can be prepared with the residual thread length can be entered before the beginning of processing of the residual thread length, and which can be counted down by a revolution sensor of the sewing machine. The microprocessor generates a signal for the control unit of the sewing machine for stopping the machine and/or activates a display means after the formation of the preset number of stitches or seams or workpieces. The monitor according to the present invention is especially suitable for use in group stitch sewing machines or automated sewing units.

To make it possible to recognize a stoppage of the bobbin caused by, e.g., thread break with the infrared laser beam falling on the roll of the residual thread length, the monitor has an additional stitch countdown counter, which can be set to a preselectable number of stitches each time the detection threshold is exceeded by the signal derived from the reflected detection beam and can be counted down by pulses sent by the revolution sensor to the microcomputer, in order to trigger a signal for stopping the machine when the zero value is reached. The sewing machine can thus be stopped a few stitches after the stoppage of the bobbin.

To achieve the highest possible insensitivity of the means according to the present invention to the effects caused by the dust generated during sewing, the infrared laser light transmitter is operated with a current intensity that comes close to its capacity. Even though this has the advantage of a high reliability in operation, it is also associated with the drawback that regardless of whether the detection beam falls on the flange of the bobbin or on the front side of the web, a continuous reflection is generated, whose nearly constant signal does not make it possible to obtain information on whether the continuous reflection can be attributed to the processing of the residual thread length or to the stoppage of the bobbin. To filter out the sinus-like signal formed during the processing of thread of the residual thread length, which changes over from one side of the detection threshold to the other side of the detection threshold, from the constant signal generated by the stoppage of the bobbin, the microcomputer has a stitch counter, which can be started by a signal change from below to above the detection threshold in order to generate a signal for the stepwise reduction of the current that can be sent to the infrared laser light transmitter by the power source from its normal operating intensity to a minimum intensity in the case of the absence of a signal change after a predeterminable number of stitches.

In order not to also carry out the stepwise reduction of the current to be sent to the infrared laser light transmitter to its minimum intensity when a signal change is already recognized during this and it is thus determined that the continuous reflection is caused during the processing of thread of the residual thread length, this reduction can be terminated by the recognized signal change.

If the second flange of the bobbin also has openings for the detection beam, it makes no difference with which of the flanges the bobbin is first introduced into the bobbin housing, i.e., it makes no difference for the scanning which of the two flanges is located adjacent to the infrared laser light transmitter. If the web is now arranged, as is shown in the drawing, eccentrically to the two flanges and the bobbin is introduced into the bobbin housing such that the flange located adjacent to the web is located adjacent to the infrared laser light transmitter, the conditions that are shown in the exemplary embodiment and also described will arise for both the residual thread chambers and the scanning of the bobbin.

If, by contrast, it is ensured during the winding up of the thread that, relative to FIG. 1, the inner area of the main chamber 9 is filled with thread first, then the residual thread chamber and subsequently the remaining area of the main chamber 9 and the bobbin thus filled is then introduced into the bobbin housing such that the inner area of the main chamber is located adjacent to the infrared laser light transmitter, a larger volume is obtained for the now broader residual thread chamber, i.e., a sufficient residual thread length can be introduced even in the case of a thicker thread. Since the distance between the reflection surfaces of the flange and of the web leads to different intensities between the detection beam emitted by the infrared laser light transmitter and the reflected detection beam sent to the receiver, a reliable evaluation result is obtained in this case as well.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
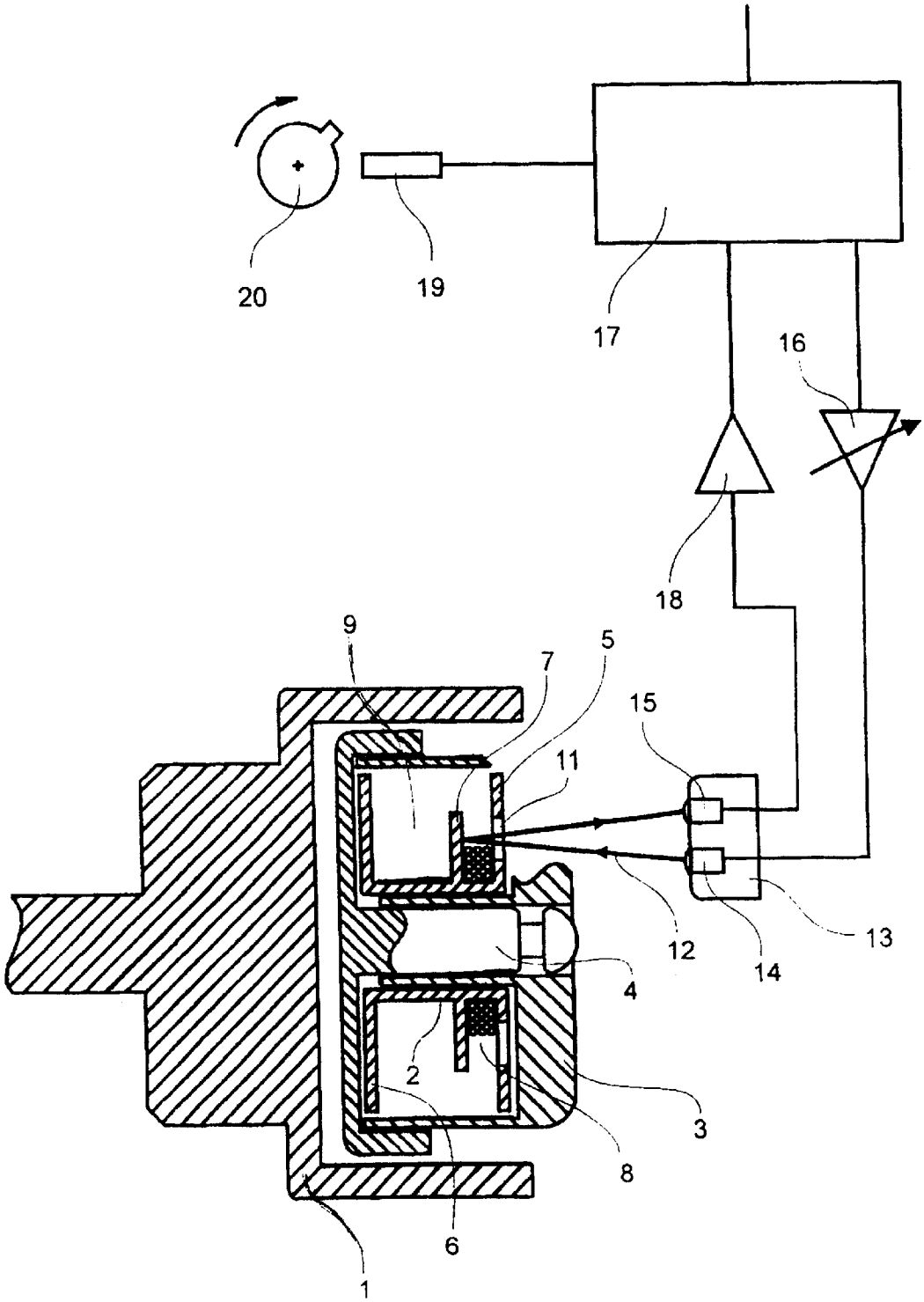
FIG. 1 is a schematic view of the monitoring device with a hook.
Figure 2:
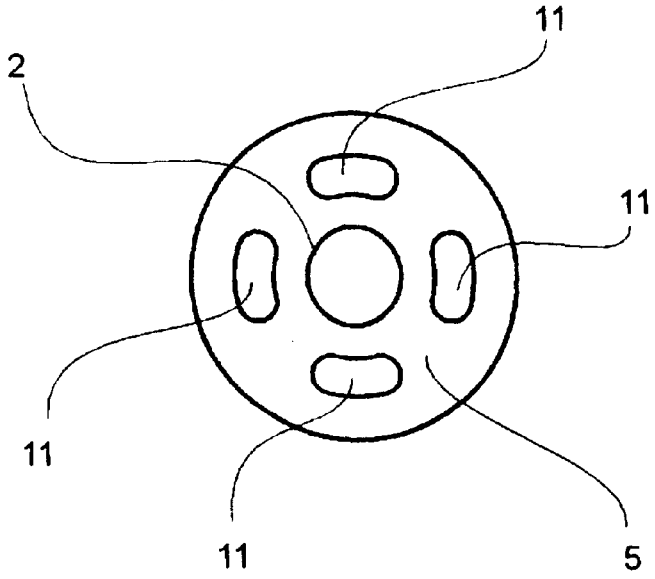
FIG. 2 is a front view of a bobbin.
Figure 3:
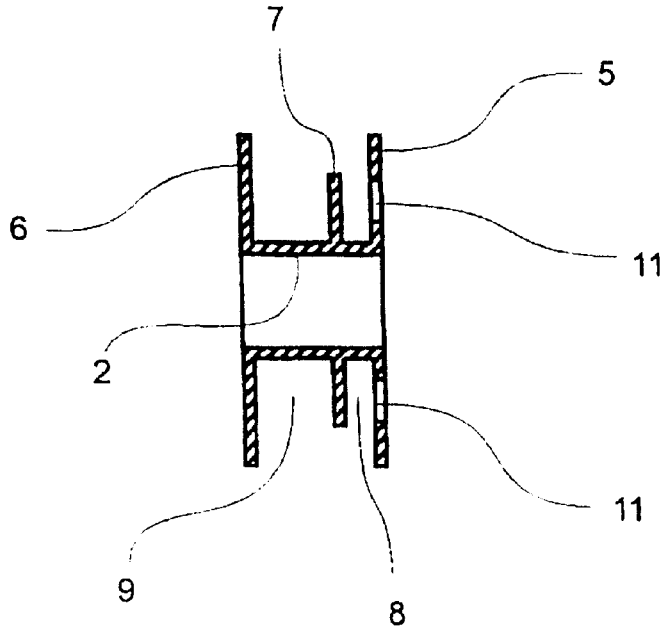
FIG. 3 is a sectional view of the bobbin.

Referring to the drawings in particular, FIG. 1 shows a basic body 1 of a hook, which has a bobbin housing 3 formed by a top part and a lower part for receiving a bobbin 2 carrying the bobbin thread reserve. The bobbin 2, received by a pin 4 of the lower part of the bobbin housing 3, has two flanges 5, 6, which are arranged at spaced locations from one another and between which a web 7 directed essentially in parallel to them is arranged. The bobbin 2 is preferably made of metal, so that both the outer lateral limiting surface of the flange 5 and the outer lateral limiting surface of the web reflect light. The web 7, which has an only relatively small radial extension, divides the storage volume of the bobbin 2 into a residual thread chamber 8 receiving the residual thread length and a main chamber 9 receiving the main thread length. Openings 11 arranged on a pitch circle are provided in the flange 5 of the bobbin 2 for a detection beam 12 designed as a laser light beam, which said openings are designed as holes or arc-shaped elongated holes. The openings 11 are arranged such that the detection beam 12 passing through them can fall on the outer area of the web 7.

A sensor head 13, which has an infrared laser light transmitter 14 and a corresponding receiver 15, which may be designed as a receiving phototransistor, is arranged above the pin 4 on the side of the basic body 1 of the hook. The input of the infrared laser light transmitter 14 is connected to a power source 16, whose current intensity can be varied, controlled by a microcomputer 17, to change the transmitted power of the infrared laser light transmitter 14. As will be explained later, the detection beam 12 emitted by the infrared laser light transmitter 14 is reflected either by the flange 5 or by the web 7 or by the thread roll of the residual thread length and is sent to the receiver 15, whose output is connected to a first input of the microcomputer 17 via an amplifier 18. A second input of the microcomputer 17 is connected to a revolution sensor 19 of the sewing machine, which sends one pulse per revolution of the main shaft 20 of the machine and consequently per stitch formation cycle to the microcomputer 17. The microcomputer 17 has a total of three stitch counters, namely, a first stitch countdown counter A, a stitch countdown counter B, and a stitch counter C, whose functions will be explained in connection with the explanation of the mode of action of the means according to the present invention.

Figure 4:
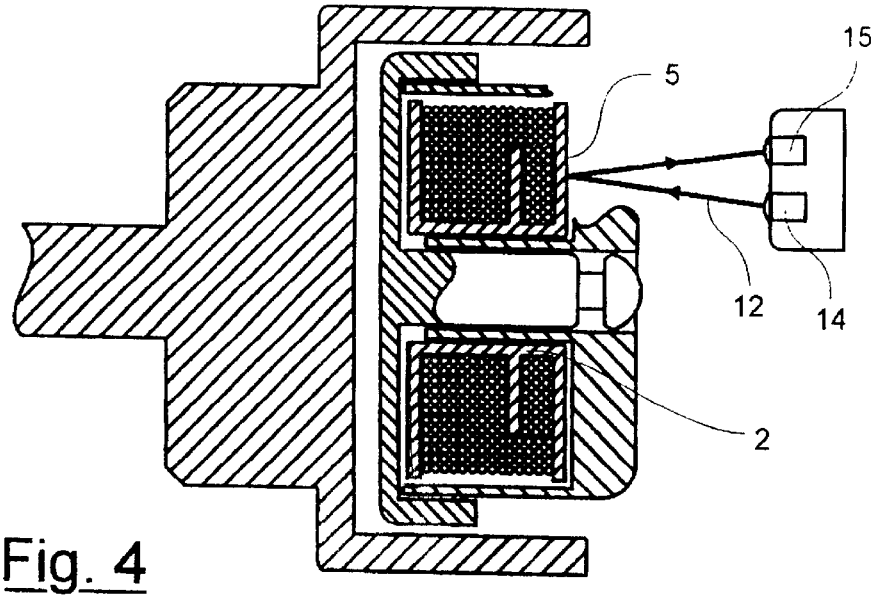
FIG. 4 is a view showing the pattern of the detection beam during the processing of thread of the main thread length with the detection beam falling on the flange of the bobbin.
Figure 5:
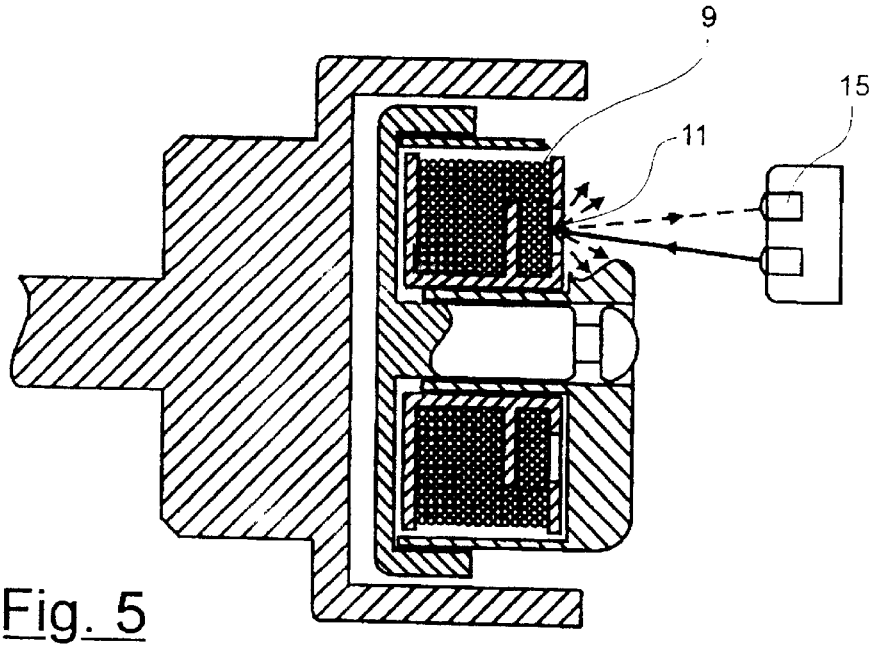
FIG. 5 is a view showing the pattern of the detection beam during the processing of thread of the main thread length with the detection beam falling on an opening.

Reference is made for this first to a first operating state of the sewing machine, in which bobbin thread from the main chamber 9 is being processed, as is shown in FIGS. 4 and 5.

In FIG. 4, the detection beam 12 emitted by the infrared laser light transmitter 14 falls on the flange 5 of the bobbin 2 and is reflected by same to the receiver 15. Since the flange 5 has a degree of reflection as is usual for metals, i.e., a relatively high degree of reflection, a signal pulse S1 with a relatively high voltage is sent to the microcomputer 17 during the time during which the detection beam 12 falls on the flange 5.

Figure 6:
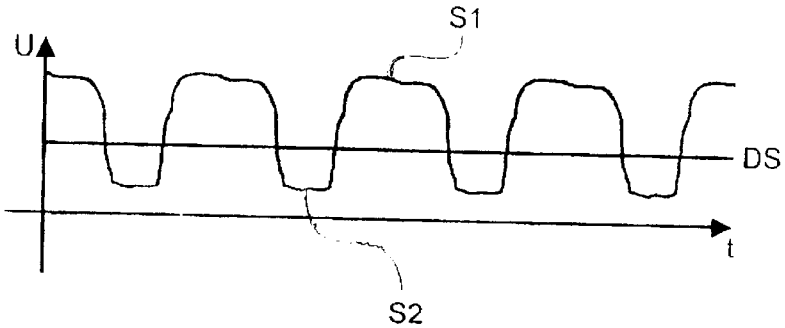
FIG. 6 is a view showing the signal pattern obtained according to FIGS. 4 and 5 with a detection threshold.

If the detection beam 12 falls on one of the openings 11 (FIG. 5) through the bobbin 2, which continues to rotate due to thread being pulled off, this beam is reflected by the surface structure of the thread roll. Since the degree of reflection of the surface of the thread is relatively low and substantially lower than that of the flange 5, this leads to a diffuse reflection, so that a signal pulse S2 of a relatively low voltage is sent by the receiver 15 to the microcomputer 17. The two signal pulses are compared in the microcomputer 17 with a preset detection threshold DS, and a signal sequence corresponding to FIG. 6 is generated when the detection threshold DS is cyclically exceeded and consumption of thread is detected. Consequently, the machine is operating in the first operating state, in which thread of the main chamber 9 is being processed.

Figure 7:
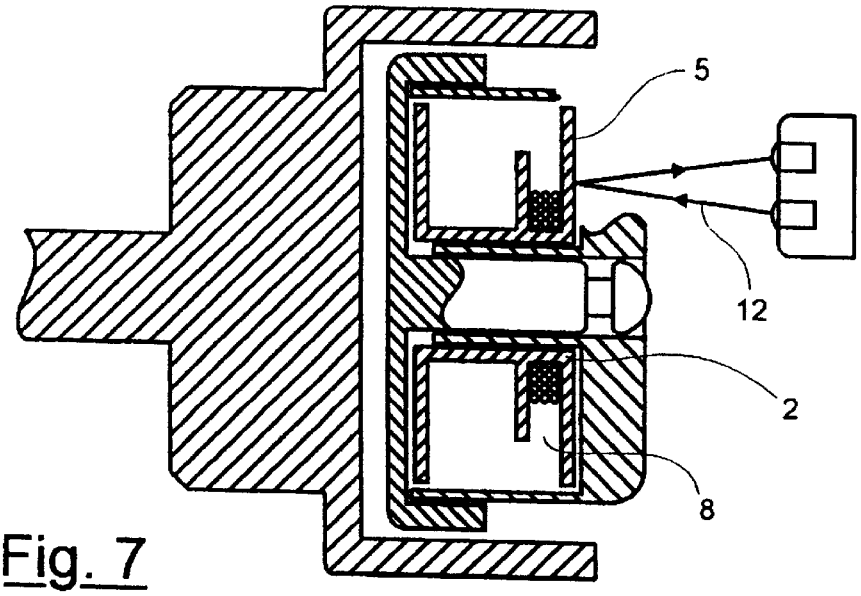
FIG. 7 is a view showing the pattern of the detection beam during the processing of thread of the residual thread length with the detection beam falling on the flange of the bobbin.

FIG. 7 shows the state in which the residual thread chamber 8 has just dropped below the detection level and thread of the area of the residual thread chamber 8 located below the detection level has begun to the processed. With the detection beam 12 falling on the flange 5 of the bobbin 2, this situation corresponds to the situation according to FIG. 4.

If the detection beam 12 falls on one of the openings 11 (FIG. 8) through the bobbin 2, which continues to rotate due to thread being pulled off, and this detection beam thus reaches the web 7, it is reflected by this web to the receiver 15. Since the web 7 has the same degree of reflection as the flange 5 of the bobbin 2, a signal pulse with a likewise relatively high voltage is sent to the microcomputer 17 during the time during which the detection beam 12 falls on the web 7. Thus, regardless of whether the detection beam 12 falls on the flange 5 or on the web 7, a continuous reflection is generated, which leads to a nearly constant signal pattern, which is shown in FIG. 9. To this are superimposed residual ripples, which may arise from both the distance between the reflection surface of the flange 5 and the reflection surface of the web 7 and the nonuniform run of the bobbin 2 as well as from vibrations of the machine. Since these residual ripples are relatively small, on the one hand, and they may be caused by several undetectable accidental events, on the other hand, it can only be inferred from the pattern of the signal that the detection level has just been reached and the machine is sewing in the second operating mode, in which thread from the residual thread chamber 8 is being processed.

If the thread length being stored in the residual thread chamber 8 is determined empirically during the filling of the bobbin 2 or it is calculated in the knowledge of the thread thickness and the storage volume of the residual thread chamber 8, and the corresponding values are stored together with the thread consumption per stitch formation cycle in the microcomputer 17, the microcomputer sets the stitch countdown counter A, which receives its pulses from the revolution sensor 19. If the stitch countdown counter A counts down to the zero value, because the residual thread length has been consumed by this point in time, the sewing machine is stopped.

If the number of stitches per seam or per workpiece is known, the still possible number of seams or workpieces that can be prepared can be entered already at the beginning of the processing of the residual thread length if the number of stitches per seam or per workpiece was entered in the microcomputer 17 in advance, so that the microcomputer 17 sends a signal to the control unit of the sewing machine for stopping the machine after the formation of the preset number of stitches or seams or workpieces and/or it activates a display device.

A special case is the breaking of the bobbin thread, which leads to the stoppage of the bobbin 2 because no thread is being pulled off. If the lower thread breaks with the detection beam 12 falling on the flange 5 of the bobbin 2 or with the detection beam 12 falling on the web 7, a continuous reflection is generated, which corresponds to the situation according to FIG. 4 with the detection beam 12 falling on the flange 5 or to the situation according to FIG. 8 with the detection beam 12 falling on the web 7. If the thread break occurs in the situation according to FIG. 5 with the detection beam 12 reaching the thread roll through an opening 11, a continuous, diffuse reflection is obtained. As a result, a permanent signal is generated below the detection threshold DS, which corresponds to the pattern of signal 2 in FIG. 6. If the signal does not change over into the range above the detection threshold DS during a defined number of stitches, the bobbin 2 is stopped and there is a disturbance caused by thread break. To detect this state, the microcomputer 17 has the stitch countdown counter B, which can be set to a preselectable number of stitches each time the detection threshold DS is undershot. If the stitch countdown counter B reaches the zero value without a changeover of the signal to above the detection threshold DS taking place, stopping of the machine with a corresponding report to the human operator is triggered as a result.

Figure 9:
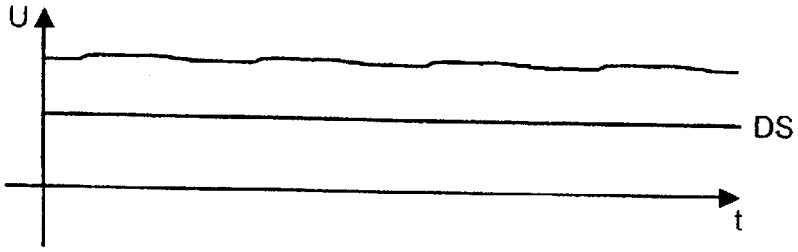
FIG. 9 is a view showing the signal pattern obtained according to FIGS. 7 and 8 with a detection threshold.
Figure 10:
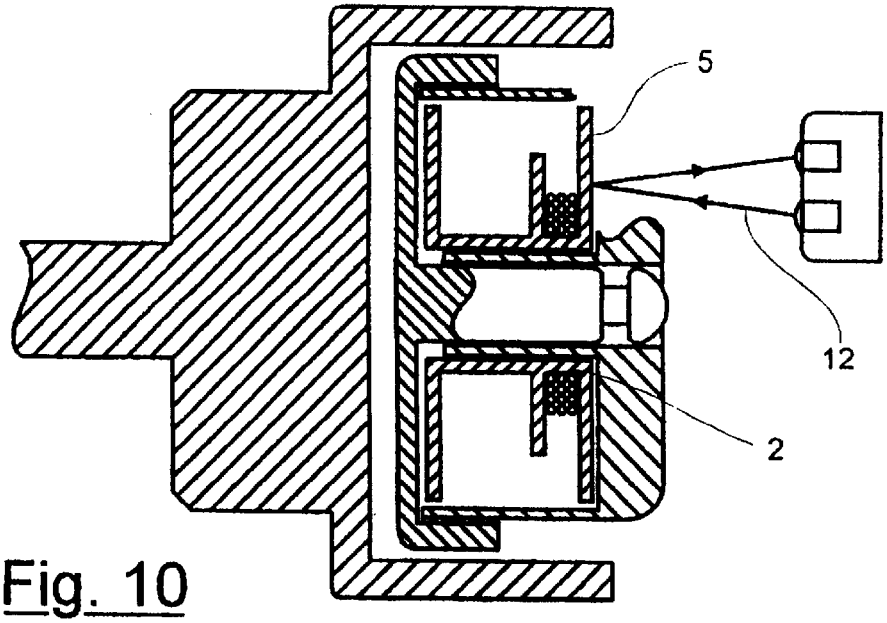
FIG. 10 is a view showing the pattern of the detection beam during the stoppage of the bobbin when the detection beam falls on the flange of the bobbin.
Figure 11:
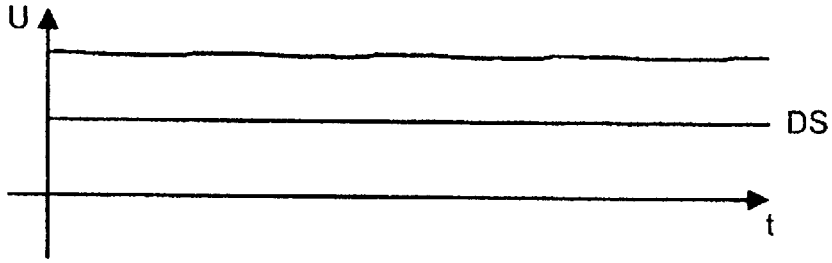
FIG. 11 is a view showing the signal pattern obtained according to FIG. 10 with a detection threshold.
Figure 12:
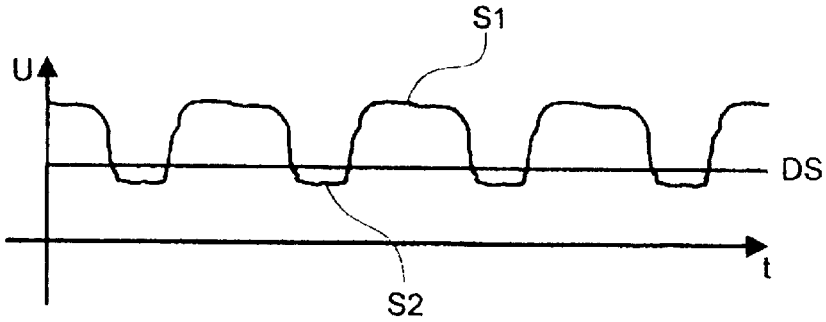
FIG. 12 is a view showing the signal pattern obtained according to FIG. 10 after reduction of the current intensity of the power source.

If the bobbin 2 stops during the break of the bobbin thread in a position in which a continuous reflection takes place, a signal pattern corresponding to FIG. 11 is obtained. This is very similar to the signal pattern according to FIG. 9 and is continuously above the detection threshold DS. It is not possible to derive any information from the continuous reflection on whether bobbin thread is being processed from the residual thread length or whether the bobbin 2 is stopped. This state may correspond to the situation according to FIG. 4, in which the detection beam 12 falls on the flange 5 of the stopped, still filled bobbin 2, or to the situation according to FIG. 8, in which the detection beam 12 falls on the web 7 of the stopped bobbin 2 still having the residual thread length, or to the situation according to FIG. 10, in which the detection beam 12 falls on the flange 5 of the stopped bobbin 2 having only the residual thread length. Since the signal pattern according to FIG. 11 is extremely similar to that according to FIG. 9, which corresponds to the processing of the residual thread length with the detection beam 12 falling on the web 7 through an opening 11, the signal pattern according to FIG. 11 does not make it possible to obtain any information on the operating state, i.e., it cannot be inferred from the signal pattern according to FIG. 11 whether it can be attributed to the stoppage of the bobbin 2 or to the proper processing of the residual thread length.

To detect this signal pattern, the stitch counter C is started each time the signal changes over from below the detection threshold DS to above the detection threshold DS. If there is no signal change to below the detection threshold DS after a defined number of stitches, e.g., two stitches, the microcomputer 17 reduces the current to the infrared laser light transmitter 14 and consequently the transmission output of this transmitter, which is at the highest possible value in the normal state, corresponding to FIG. 13, to a somewhat lower value by means of the controllable power source 16. If a signal change still fails to occur, the current is reduced by an additional amount after a defined number of stitches. The reduction in the transmission output leads to a sensitization of the means. As a result, the difference in the distances between the reflection surfaces of the flange 5 and the web 7, on the one hand, and the infrared laser light transmitter 14, on the other hand, is sufficient to recognize a signal change when the bobbin 2 is still rotating at a defined transmission output.

The reduction of the current that can be fed to the infrared laser light transmitter 14 may be repeated until a minimum current is reached. If a signal change still fails to occur, the bobbin 2 is stopped, i.e., no thread is being pulled off. Stopping of the machine with a corresponding report to the human operator is likewise triggered in this case. If a signal change takes place at a reduced transmission output, it can be assumed that the bobbin 2 is rotating and the residual thread length is being processed at this point in time corresponding to the situation according to FIG. 8. The output of the infrared laser light transmitter 14 can again be reset to its maximum value for a new cycle.

It is achieved by the stepwise reduction that the operation can be carried out with a relatively high transmission output in the normal operation, especially during the processing of the bobbin thread being stored in the main chamber 9 in order to have sufficient power reserves even in the case of poorer reflection behavior caused by contamination or tolerances related to manufacture or assembly, on the one hand, and, on the other hand, to still make different signal patterns recognizable during the detection of a certain operating state with a sufficiently low transmission output from the difference in the distances between the respective reflection surfaces of the flange 5 and the web 7, on the one hand, and the infrared laser light transmitter 14, on the other hand.

Figure 13:
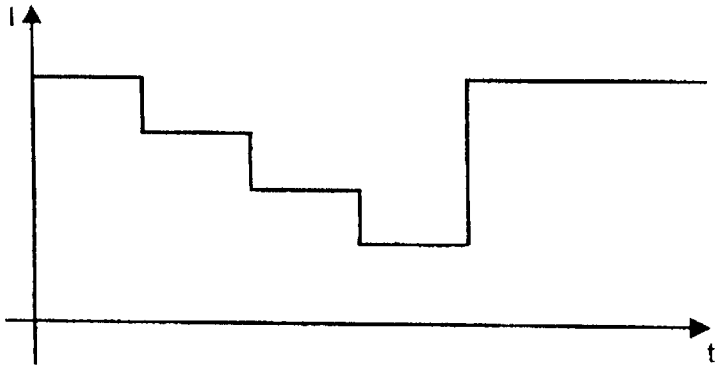
FIG. 13 is a view showing the curve of the current intensity during the stepwise reduction of the current intensity of the power source.

The signal patterns of the above-described operation are shown in FIGS. 13 through 18. FIG. 13 shows the reduction of the current reaching the infrared laser light transmitter 14 from the controllable power source 16, which is initiated by the microcomputer 17 and takes place in a plurality of steps, in order to bring about a stepwise reduction of the transmission output of the infrared laser light transmitter.

Figure 14:
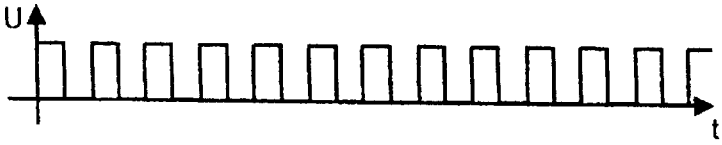
FIG. 14 is a view showing the assignment of the stitches formed during the reduced current intensity.
Figure 15:
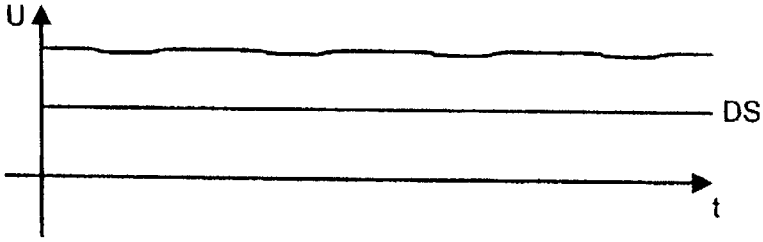
FIG. 15 is a view showing the signal pattern which contains no information on the operating state after the reduction of the current intensity of the power source with the detection threshold.

FIG. 14 shows the particular number of stitches, assigned chronologically, which are formed consecutively after the particular start of the stitch counter C at a particular reduced output of the infrared laser light transmitter 14.

FIG. 15 shows once again the signal pattern during the continuous reflection, and it can be recognized from this figure that this [signal pattern] is above the detection threshold DS and no information can be derived from it with respect to the operating state of the machine.

Figure 16:
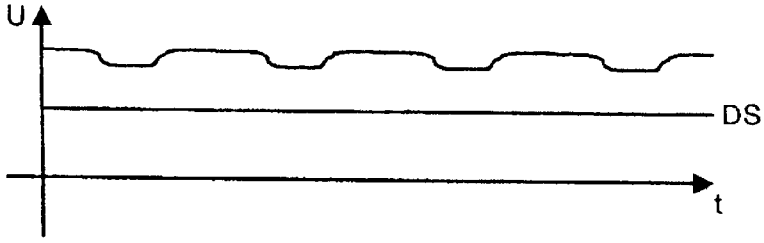
FIG. 16 is a view showing the signal pattern after the reduction of the current intensity of the power source during the processing of thread of the residual thread length according to FIG. 8.

FIG. 16 shows the situation in which the current sent to the infrared laser light transmitter 14 is reduced by a first step. The intensity of the signals is reduced corresponding to the reduced current intensity, but the signal pattern is still above the detection threshold DS. Even though the signal pattern already has ripples, they are still insufficient for obtaining any information concerning the operating state because of the small difference from the signal pattern seen during continuous reflection.

Figure 17:
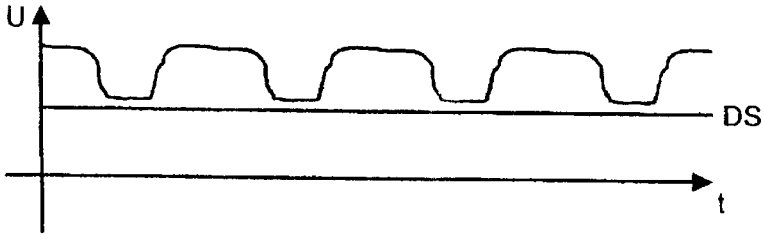
FIG. 17 is another view showing the signal pattern after the reduction of the current intensity of the power source during the processing of thread of the residual thread length according to FIG. 8.

FIG. 17 shows the situation in which the current fed to the infrared laser light transmitter 14 is reduced by two steps. The intensity of the signals is reduced corresponding to the reduced current intensity, but the signal pattern is still above the detection threshold DS. The ripples of the signal pattern are more pronounced and have a contour that comes close to that seen during the processing of thread from the residual thread chamber 8. However, since the signal pattern is still on the same side of the detection threshold DS and therefore there is no signal change as yet, it is not yet possible to obtain any reliable information concerning a signal change, and it is consequently also impossible to obtain any reliable information on the operating state.

Figure 18:
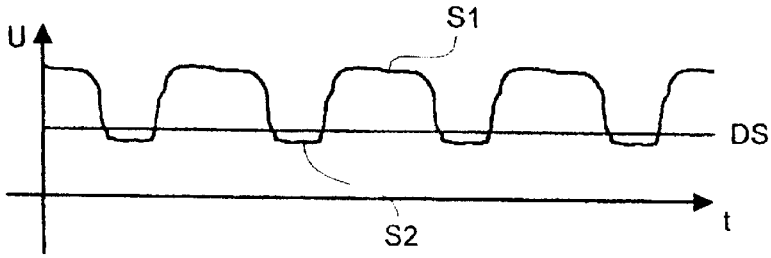
FIG. 18 is another view showing the signal pattern after the reduction of the current intensity of the power source during the processing of thread of the residual thread length according to FIG. 8.

FIG. 18 shows the situation in which the intensity of the current sent to the infrared laser light transmitter 14 is reduced by a total of three steps. At the same time, this current intensity is also the minimum current intensity to be sent to the infrared laser light transmitter 14. The signal pattern drops below the detection threshold DS and corresponds to that seen during the proper consumption of thread of the residual thread chamber 8. The signal pattern according to FIG. 11, which is generated using the normal operating current of the infrared laser light transmitter 14 and from which continuous reflection can be inferred, can be recognized due to the repeated reduction of the current to be sent to the infrared laser light transmitter 14 as the signal pattern that corresponds to the signal pattern seen during the proper processing of thread of the residual thread chamber 8.

Figure 8:
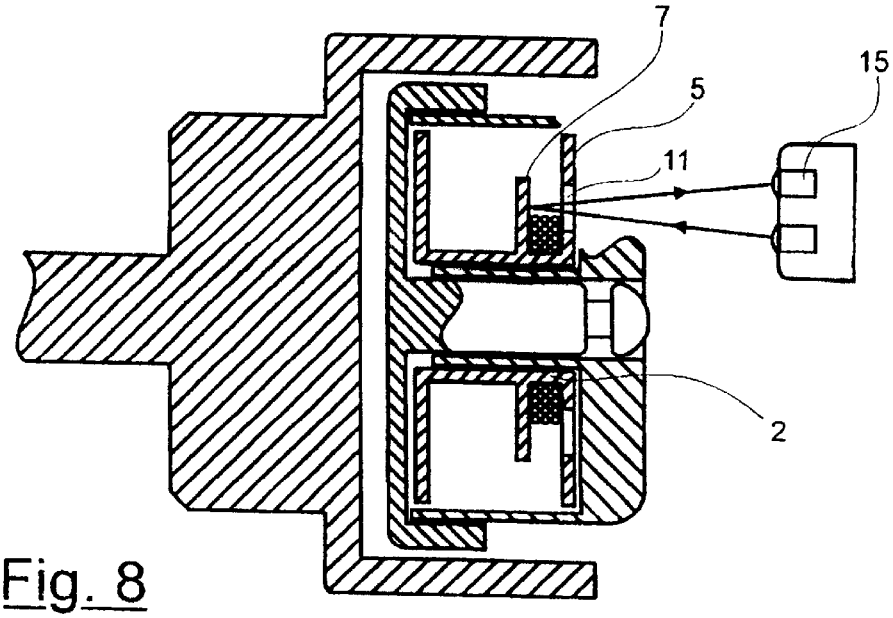
FIG. 8 is a view showing the pattern of the detection beam during the processing of thread of the residual thread length with the detection beam falling on an opening.

While signals that point to a continuous reflection and do not make it possible to obtain any information concerning the operating state of the machine are generated during the operation of the infrared laser light transmitter 14 with normal current intensity, this apparent continuous reflection can be recognized as a signal pattern associated with the proper consumption of thread of the residual threads chamber 8 during the operation of the infrared laser light transmitter 14 with a current intensity temporarily reduced in a stepwise manner, so that the microcomputer 17 will recognize after only a few stitches that this is a signal pattern that corresponds to the situation according to FIG. 8, and a signal for stopping the machine with a corresponding report to the human operator is triggered.

While specific embodiments of the invention have been shown and described in detail to illustrate the application of the principles of the invention, it will be understood that the invention may be embodied otherwise without departing from such principles.

What is claimed is:

1. A monitor for bobbin thread on double thread lockstitch sewing machines with a rotating hook with a bobbin housing accommodating the lower thread reserve, the monitor comprising:

a revolution sensor sending a pulse per revolution of the main shaft of the machine to a microcomputer;

an infrared laser light transmitter for sending a detection beam directed toward a bobbin and which is reflected by a bobbin surface or by the roll of a residual thread length;

a receiver for detecting reflected light;

a microcomputer receiving signals from said receiver in the form of signals for processing, evaluation and/or forwarding, said microcomputer having a comparator for comparing the different signal patterns with a detection threshold to generate signals for controlling the sewing machine;

a controllable power source connected to said microcomputer for an occasional stepwise reduction of the output of the infrared laser light transmitter;

a bobbin inserted into the bobbin housing and with at least two chambers separated from one another by a radially directed web having a front surface facing the infrared laser light transmitter, wherein a residual thread chamber accommodates a residual thread length and a main chamber accommodates the main thread length, the bobbin surface including an outer surface of a flange of said bobbin, said outer surface being adjacent to a front light reflecting surface wherein said flange has openings for the detection beam.

2. A monitor in accordance with claim 1, wherein the microcomputer has a stitch countdown counter, to which the number of stitches or seams or workpieces that can still be prepared with the residual thread length can be sent after the recognition of the processing of the residual thread length, and which can be counted down by the revolution sensor of the sewing machine in order to send a signal for stopping the machine to the control unit of the sewing machine after the formation of the preset number of stitches or seams or workpieces and/or to activate a display device.

3. A monitor in accordance with claim 1, wherein to recognize the stoppage of the bobbin with the detection signal falling on the thread roll of the bobbin, the microcomputer has a stitch countdown counter, which can be set to a preselectable number of stitches whenever the signal derived from the reflected detection beam drops below the detection threshold, and which can be counted down by pulses sent by the revolution sensor to the microcomputer, and it triggers a signal for stopping the machine and/or for a display device when the zero value is reached.

4. A monitor in accordance with claim 1, wherein to recognize a sinus-like signal pattern within a signal pattern formed by a continuous reflection of the detection beam, which does not drop below the detection threshold, the microcomputer has a stitch counter, which can be started by a signal change from below to above the detection threshold in order to generate a signal for the stepwise reduction of the current that can be sent to the infrared laser light transmitter by the power source from its normal operating intensity to a minimum intensity when a signal change fails to occur after the predeterminable number of stitches.

5. A monitor in accordance with claim 4, wherein the stepwise reduction of the current that can be sent to the infrared laser light transmitter by the power source can be terminated by a signal change occurring during the stepwise reduction.

6. A monitor in accordance with claim 1, wherein said web has openings for the detection beam.

7. A bobbin thread monitor for a sewing machine with a bobbin housing accommodating a lower thread reserve, the monitor comprising:

a revolution sensor sending a pulse signal based on the revolution of the main shaft of the machine;

an infrared laser light transmitter for sending a detection beam directed toward a bobbin space in the bobbin housing;

a receiver for detecting reflected light;

a microcomputer receiving signals for one or more of processing, evaluation and forwarding from said receiver, said microcomputer having a comparison means for comparing the different signal patterns with a detection threshold to generate signals for controlling the sewing machine;

a controllable power source connected to said microcomputer for a controlled stepwise change of the output of the infrared laser light transmitter;

a bobbin inserted into the bobbin housing and with at least two chambers separated from one another by a radially directed web with a front surface of a web facing the infrared laser light transmitter and said bobbin having an outer surface of a flange of said bobbin facing the infrared laser light transmitter, said outer surface being adjacent to a front light reflecting surface wherein a residual thread chamber accommodates a residual thread length and a main chamber accommodates the main thread length, said flange having openings for the detection beam.

8. A monitor in accordance with claim 7, wherein the microcomputer has a stitch countdown counter, to which the number of stitches or seams or workpieces that can still be prepared with the residual thread length can be sent after the recognition of the processing of the residual thread length, and which can be counted down by the revolution sensor of the sewing machine in order to send a signal for stopping the machine to the control unit of the sewing machine after the formation of the preset number of stitches or seams or workpieces and/or to activate a display device.

9. A monitor in accordance with claim 7, wherein to recognize the stoppage of the bobbin with the detection signal falling on the thread roll of the bobbin, the microcomputer has a stitch countdown counter, which can be set to a preselectable number of stitches whenever the signal derived from the reflected detection beam drops below the detection threshold, and which can be counted down by pulses sent by the revolution sensor to the microcomputer, and it triggers a signal for stopping the machine and/or for a display device when the zero value is reached.

10. A monitor in accordance with claim 7, wherein to recognize a sinus-like signal pattern within a signal pattern formed by a continuous reflection of the detection beam, which does not drop below the detection threshold, the microcomputer has a stitch counter, which can be started by a signal change from below to above the detection threshold in order to generate a signal for the stepwise reduction of the current that can be sent to the infrared laser light transmitter by the power source from its normal operating intensity to a minimum intensity when a signal change fails to occur after a predeterminable number of stitches.

11. A monitor in accordance with claim 10, wherein the stepwise reduction of the current that can be sent to the infrared laser light transmitter by the power source can be terminated by a signal change occurring during the stepwise reduction.

12. A monitor in accordance with claim 7, wherein said web has openings for the detection beam.

* * * * *